US005611138A

United States Patent [19]

Krampe

[11] Patent Number: 5,611,138

[45] Date of Patent: Mar. 18, 1997

[54] PLIER-SHAPED TOOL TO DRILL A PARTIALLY FREE END REGION OF A STRANDED VEIN OF AN INSULATED CONDUCTOR

[76] Inventor: Josef Krampe, An der Vogelrute 32, D-59387, Ascheberg, Germany

[21] Appl. No.: 424,899

[22] Filed: Apr. 19, 1995

[30] Foreign Application Priority Data

Apr. 20, 1994 [DE] Germany ..... 44 13 748.6

[51] Int. Cl.[6] ..... H01R 43/00

[52] U.S. Cl. ..... 29/564.4; 29/750; 81/9.4; 140/121

[58] Field of Search ..... 29/564.4, 33 M, 29/750, 566.4; 81/9.4, 9.41, 9.43; 140/1, 118, 119, 120, 121

[56] References Cited

U.S. PATENT DOCUMENTS

| | | | |
|---|---|---|---|
| 3,994,188 | 11/1976 | Baba et al. | 140/1 X |
| 4,782,578 | 11/1988 | Wu | 29/564.4 |
| 5,063,795 | 11/1991 | Krampe | 81/9.43 |

FOREIGN PATENT DOCUMENTS

| | | | |
|---|---|---|---|
| 501360 | 4/1954 | Canada | 140/121 |
| 619302 | 9/1935 | Germany | 81/9.4 |
| 710344 | 9/1941 | Germany | 140/121 |
| 136684 | 11/1978 | Japan | 81/9.4 |
| 454626 | 12/1974 | U.S.S.R. | 81/9.4 |
| 936139 | 6/1982 | U.S.S.R. | 81/9.4 |
| 995180 | 2/1983 | U.S.S.R. | 81/9.4 |
| 1125689 | 11/1984 | U.S.S.R. | 81/9.4 |

*Primary Examiner*—William R. Briggs
*Attorney, Agent, or Firm*—Max Fogiel

[57] ABSTRACT

A pliers-like tool for twisting the partly stripped end of the multiple-strand core of an insulated conductor, characterized by projections 41 and 42 extending out of the free end of each jaw 121 & 131 and toward the other jaw into the space between them, whereby the projections follow the arc described by the opening and closing jaws, the projections are not coplanar, and space is accordingly left between them, one of the projections is long enough to overlap the other to a limited extent when the jaws are separated, and the surfaces of the jaws that demarcate the space between them are high-friction. The conductor is cut to length, insulation is stripped from the end of the core to a limited extent, the end of the core is twisted between the high-friction surfaces, and a connector is extracted from a belt and crimped around the twisted end, all by the same tool.

15 Claims, 7 Drawing Sheets

PLIER-SHAPED TOOL TO DRILL A PARTIALLY FREE END REGION OF A STRANDED VEIN OF AN INSULATED CONDUCTOR

BACKGROUND OF THE INVENTION

The present invention concerns a pliers-like tool for twisting the partly stripped end of the multiple-strand core of an insulated conductor. The invention also concerns an embodiment of the tool that can be employed to carry out all the operations involved in mounting a cylindrical connector on the end of such a core.

Tools for twisting the end of such a multiple-strand core so that a cylindrical connector can be mounted on it are known. Such tools, however, are complicated and easy to break, and access to the section to be twisted is difficult. There is accordingly room for improvement by combining all the functions involved in mounting the connector into one tool.

SUMMARY OF THE INVENTION

One object of the present invention is accordingly a simpler and accordingly more robust and easier to use pliers-like tool for twisting the partly stripped end of the multiple-strand core of an insulated conductor. Another object of the invention is an embodiment of such a tool than can be employed to carry out all the operations involved in mounting a cylindrical connector on the end of such a core.

This object is attained in accordance with the present invention in a tool of the aforesaid genus by projections extending out of the free end of each jaw and toward the other jaw into the space between them. The projections follow the arc described by the opening and closing jaws. The projections are not coplanar, and space is accordingly left between them. One of the projections is long enough to overlap the other to a limited extent when the jaws are separated. The surfaces of the jaws that demarcate the space between them are high-friction.

The tool in accordance with the present invention is conceptually simple and accordingly robust. A related advantage is that the space between the jaws need not be occupied by additional components, such as holding-and-cutting mechanisms that have to be positioned by the jaws in order to strip insulation from the end of the conductor, that are needed to carry out all the operations involved in mounting a cylindrical connector on the end of a stripped core.

The most significant characteristic of the present invention is the "node" with its cassette accommodated in a jaw. The cassette includes links between components that force the connector over the stripped end of the core, separate a connector from a belt of connectors in a clip, and if necessary straighten out the conductor, in conjunction with the conceptually simple mechanisms that operate the tool.

The invention will now be specified with reference to the accompanying drawing, which represents a pliers-like tool for twisting the partly stripped end of the multiple-strand core of an insulated conductor, twisting the core, and crimping the connector, whereby.

DESCRIPTION OF THE PREFERRED EMBODIMENTS

Figure 1:
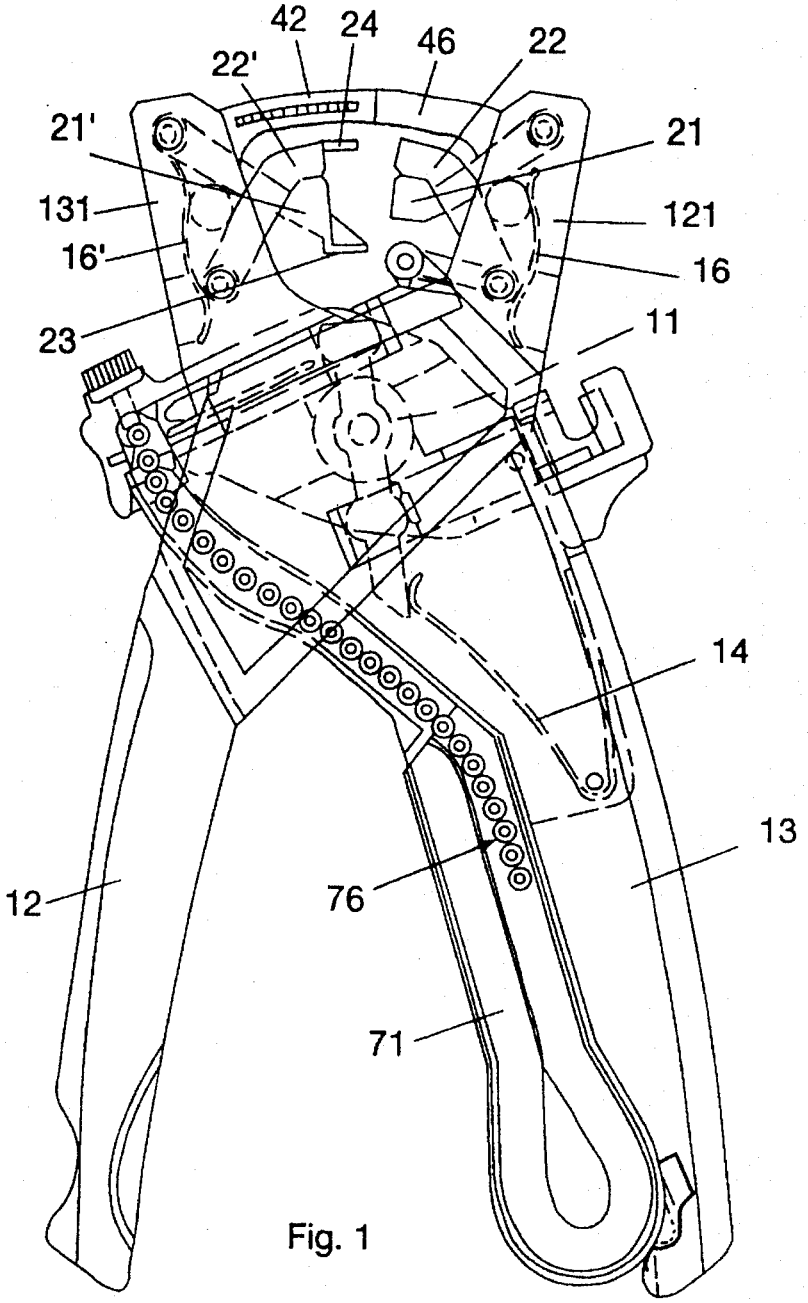
FIG. 1 is a side view of the open tool.
Figure 2:
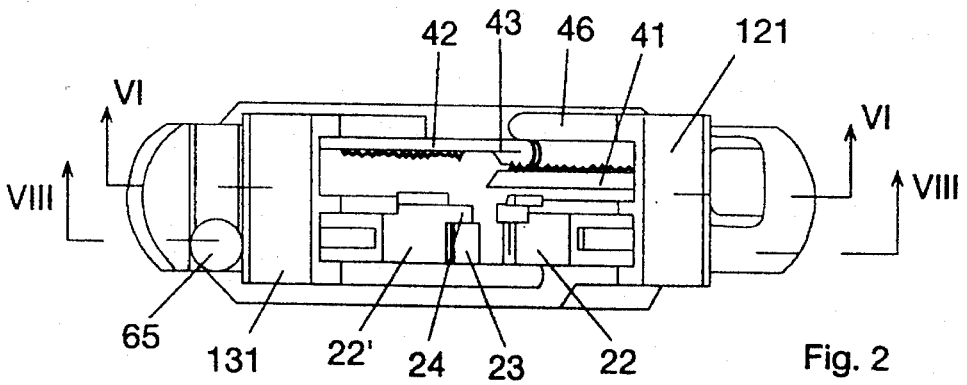
FIG. 2 a front view of the tool illustrated in FIG. 1.
Figures 3, 4:
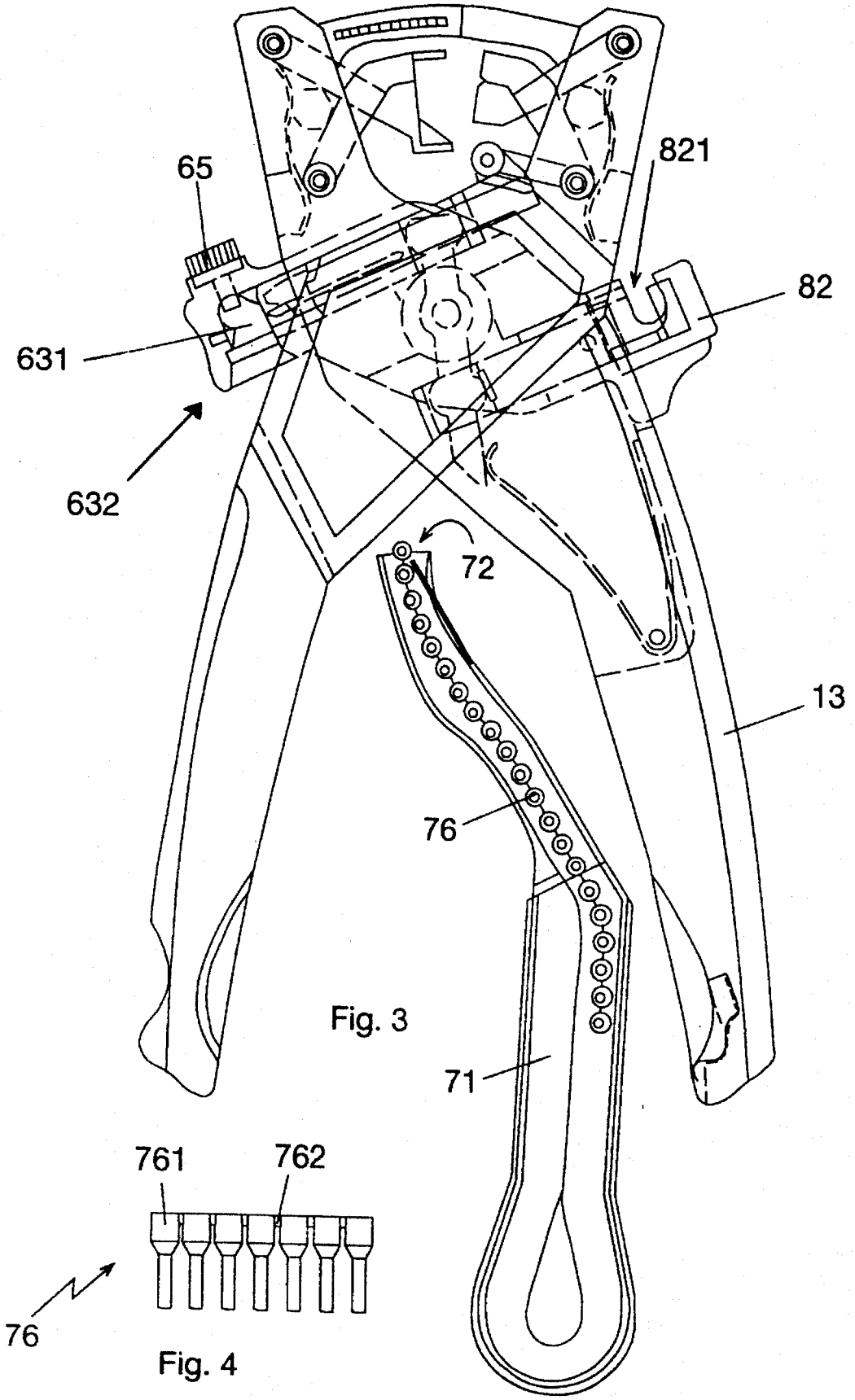
FIG. 3 a view of the tool and its connector clip separated.
FIG. 4 a side view of part of a belt of connectors.
Figure 5:
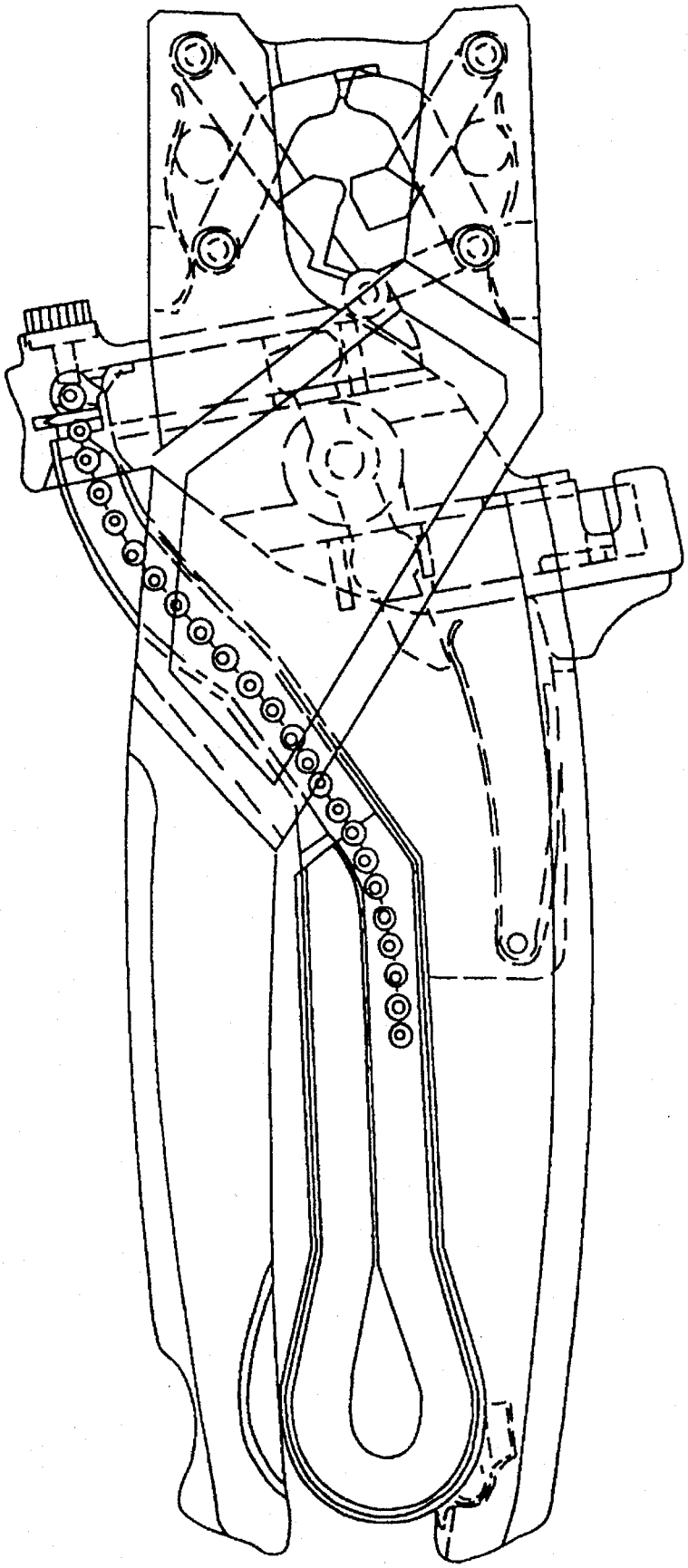
FIG. 5 a side view of the closed tool.
Figure 6:
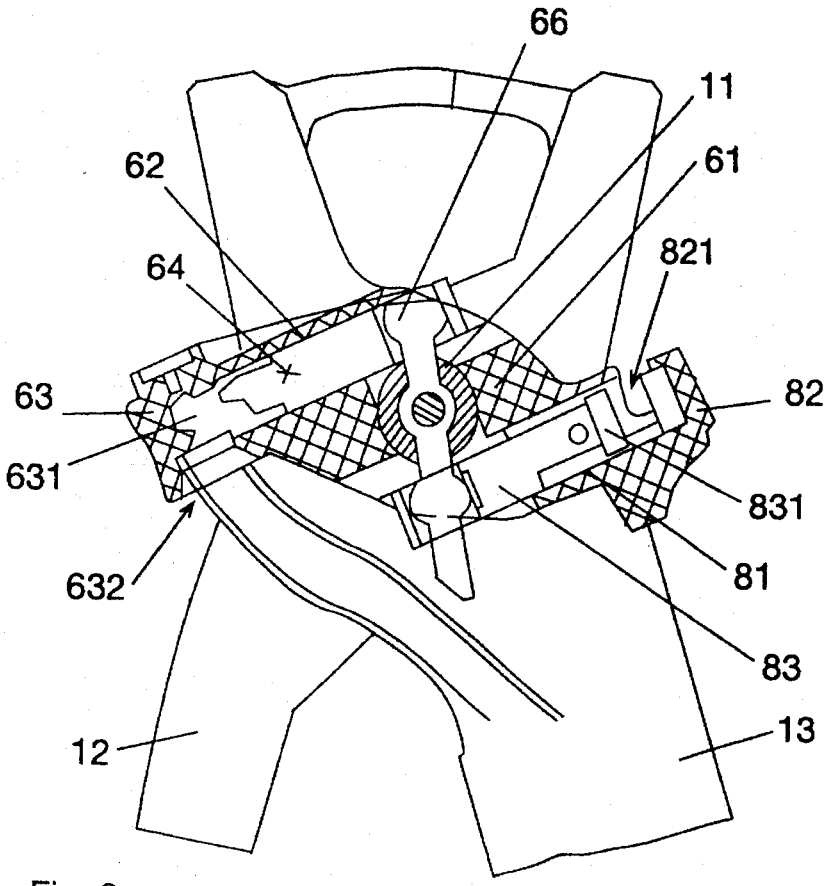
FIG. 6 a side view of, and a section along the line VI—VI in FIG. 2, of the vicinity of the jaws of the open tool, FIG. 7 a view and section similar to FIG. 6 of the same vicinity of the closed tool, FIG. 8 a side view of, and a section along the line VIII—VIII in FIG. 2, of the vicinity of the jaws of the open tool, FIG. 9 a view and section similar to FIG. 8 of the same vicinity of the closed tool, FIG. 10 a side view of the node and its vicinity, FIG. 11 a section along the line XI—XI in FIG. 10, FIG. 12 a sequence representing the steps involved in stripping the insulation from the core, FIG. 13 a sequence illustrating the steps involved in twisting the end of the core, and FIG. 14 views of the area illustrated in FIG. 10 in the direction indicated by arrow XIV in FIG. 13.
Figure 7:
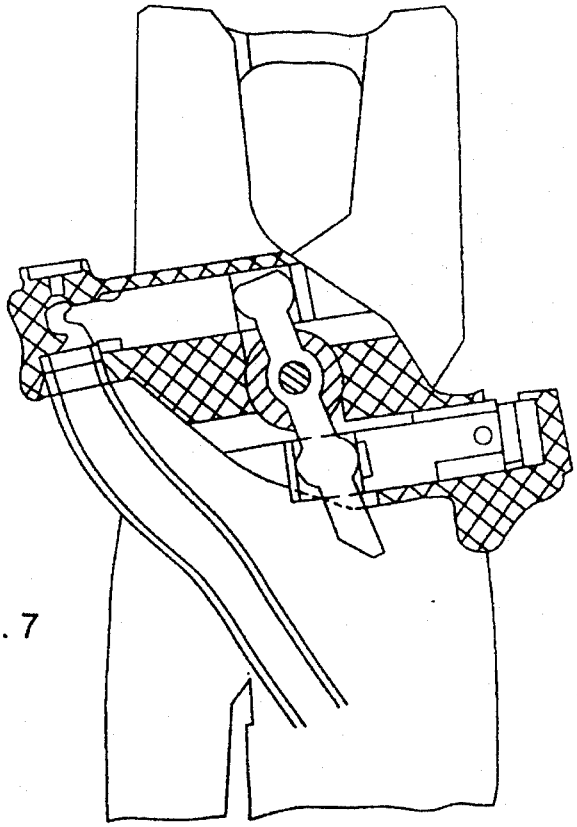
Figure 8:
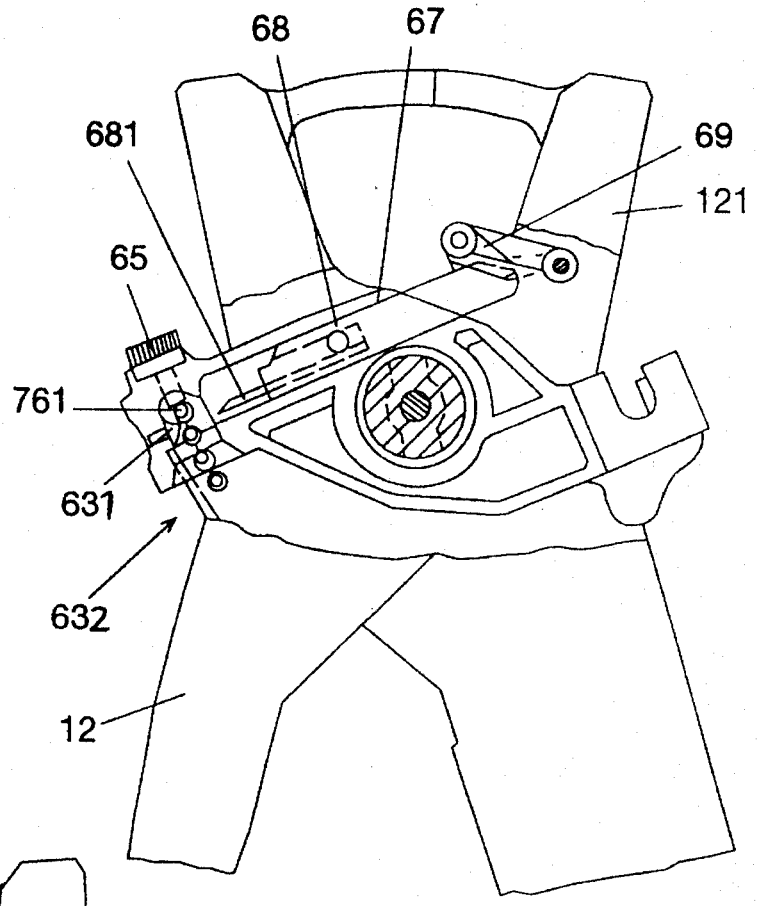
Figure 9:
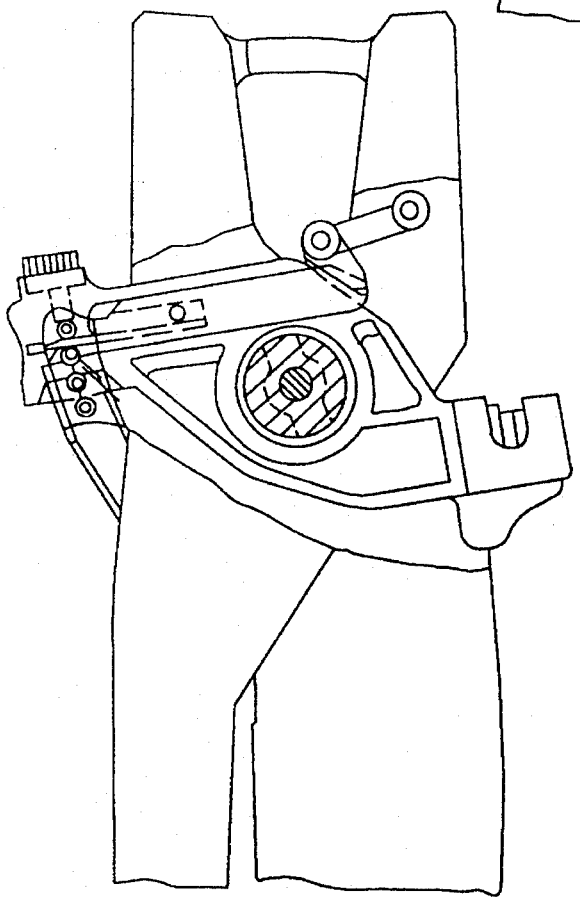
Figure 10:
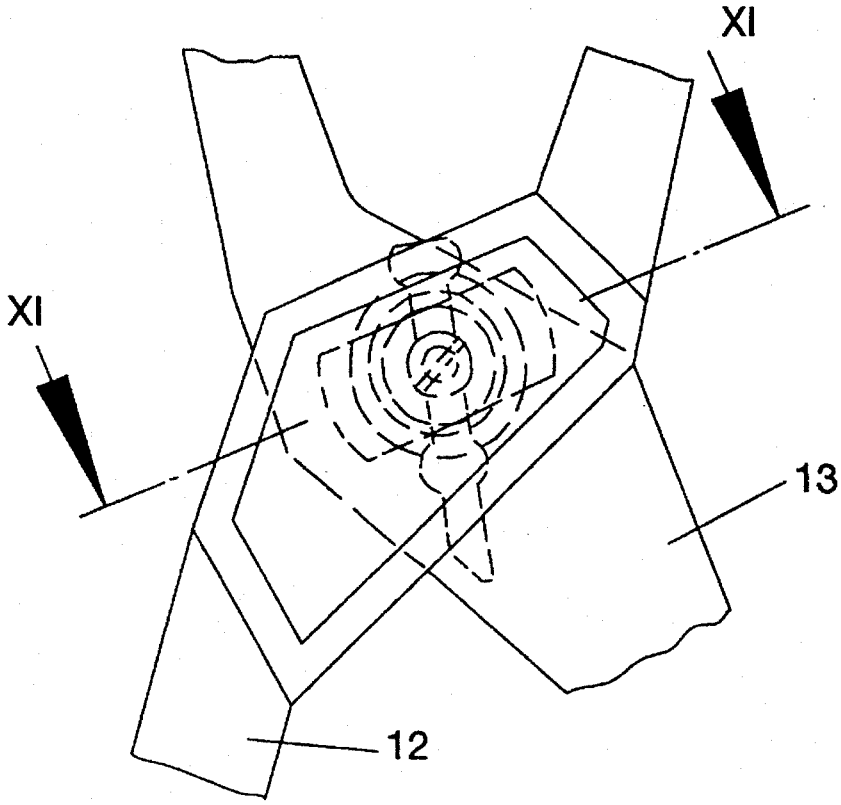
Figure 11:
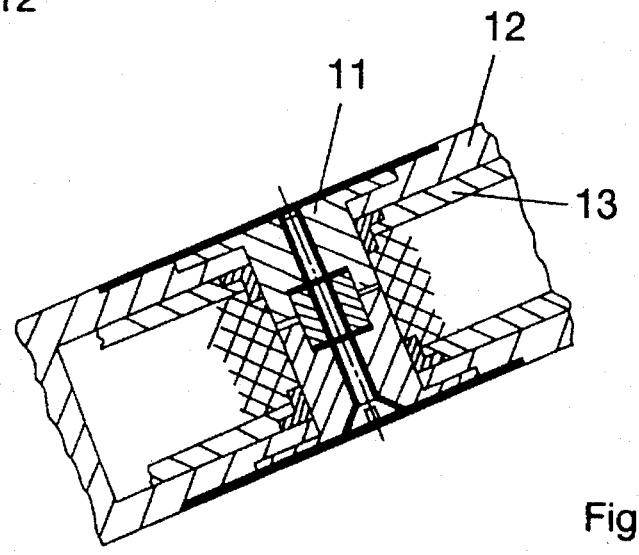

The pliers-like tool illustrated as a whole in FIGS. 1, 2, and 3 conventionally consists of two handles 12 and 13. Handle 13 extends through handle 12 and pivots in it at a pivot 11. Handles 12 and 13 extend beyond pivot 11 into jaws, jaw 121 on handle 12 and jaw 131 on handle 13. Pivoting on jaw 121 are holding-and-severing mechanisms 21 and 22, and pivoting on jaw 131 are holding-and-severing mechanisms 21' and 22'. Mechanisms 21 & 21' and 22 and 22' are employed for the first stage of stripping the insulation from the end of a multiple-strand core. That procedure will now be specified. A conductor 31 comprising a multiple-strand core and insulation 311 is inserted into the tool in the direction indicated by arrow A. Squeezing the tool secures conductor 31 between mechanisms 21 and 21', while mechanisms 22 and 22' sever insulation 311. When the tool is released, a spring 14 separates handles 12 and 13, a spring 16 separates holding-and-severing mechanisms 21 and 22, and a spring 16' separates holding-and-severing mechanisms 21' and 22'. As the springs separate mechanisms 21 and 21' from mechanisms 22 and 22' in the direction indicated by double-headed arrow B in FIG. 12, the excess insulation 311' is partly removed in the direction indicated by arrow C in the same figure from the section 31' of the core beyond the incision. The severed insulation is removed only partly because the components must be prevented from acting directly on the core. How far the insulation is removed depends on how far the conductor is inserted into the tool as defined by a stop 23 that projects out of an extension on holding mechanisms 21'. A thruster 24 projects out of severing mechanism 22' and operates in conjunction with severing mechanism 22, synchronizing their action and hence that of the holding mechanisms as well. Thruster 24 also helps guide the conductor as the latter is inserted into the tool.

Figure 13:
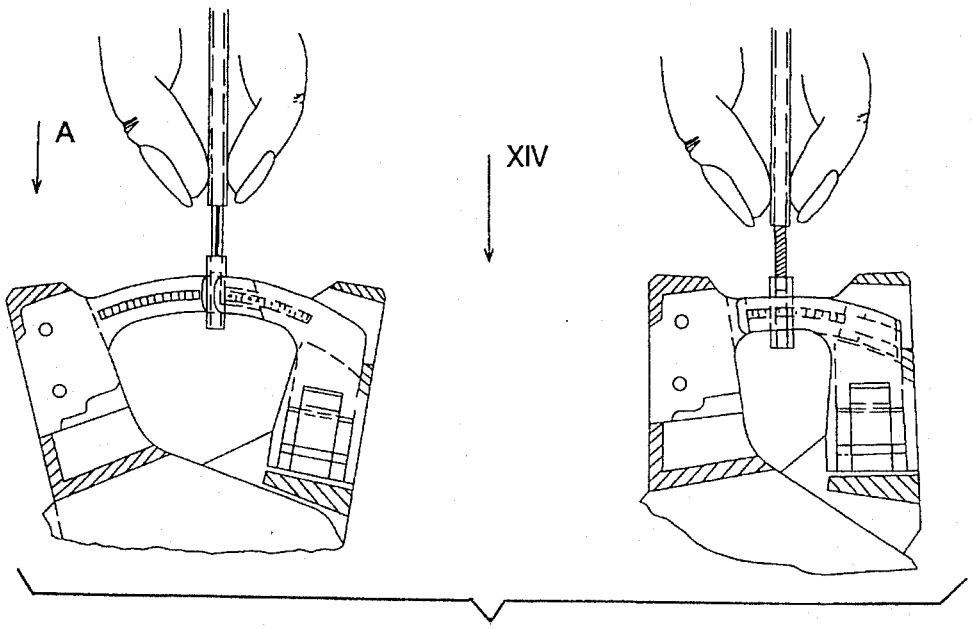
Figure 14:
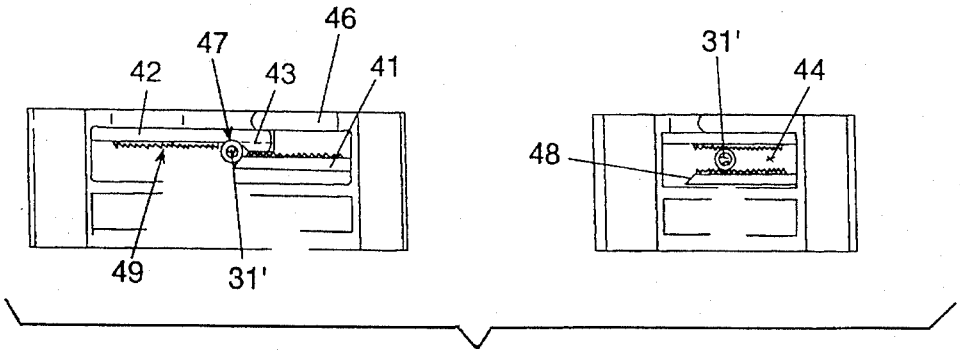

Upstream of the stripped area is the special strand-twisting mechanism in accordance with the present invention illustrated in FIGS. 13 and 14 in particular. It comprises projections 41 and 42 that extend toward each other along an arc, each in a different plane, and slide over each other leaving a space between them as the handles are squeezed together. Projection 41 extends out of jaw 121 and projection 42 out of jaw 131. Projection 42 has a shallow elevation 43 that occupies the space 44 (FIG. 14) between the projections. Space 44 is demarcated by a projection 46 that also extends out of jaw 121 at a distance from projection 41. The projection 42 extending out of jaw 131 extends between projections 46 and 41. A depression 47 upstream of elevation 43 positions the end of the conductor. An access ramp 48 on the projection 41 extending out of jaw 121 helps to secure the twisting mechanism. The twisting process itself is supported at least by serrated sections 49 integrated into the projections. Sections 49 are elevated above the surface of projections 41 and 42 and also support the complete removal of the severed and only partly removed section 311' as the twisting of exposed section 31' of core.

Also integrated into the tool is the mechanism for crimping a connector onto the previously stripped and twisted core illustrated in FIGS. 6 through 9. The actual crimping mechanism, illustrated in FIGS. 6 and 7, comprises a cassette 61. Cassette 61 extends through adjustable handle 13 where it is articulated to handle 12 at pivot 11. Integrated into the cassette is a bolt 62 with an extension 63 that extends beyond handle 12. Integrated into extension 63 is a connector-crimping chamber 631. Chamber 631 can be accessed perpendicular to the plane of projection. A cylindrical connector 761 resting on core section 31' is forced into the crimping chamber and toward that section by a die 64. Die 64 travels back and forth in bolt 62. The die is forced toward and away from chamber 631 by a lever 66. Lever 66 pivots around the same pivot 11 handles 12 and 13 pivot around. The extension in bolt 62 that constitutes connector-crimping chamber 631 also has an intake 632, which is accessible perpendicular to the plane of projection. Intake 632 extends along the plane of projection and accommodates the free end of connector belt 76 illustrated in FIG. 4. Also at extension 63 in bolt 62 is a screw 65 that adjusts the chamber 631 for connectors of different size. Crimping chamber 631 is loaded with a connector 761 from a belt 76 from a clip 71 that can be removed from adjustable handle 13. The exit 72 of clip 71 opens into the intake 632 into chamber 631. The connector 761 at the front end of belt 76 is advanced into chamber 631 by insulated conductor 31. The stripped and twisted section 31' of conductor 31 is introduced into connector 761 perpendicular to the plane of projection. Section 31' is forced toward chamber 631 parallel to the plane of projection, transferring the connector into the chamber. Once connector 761 and the section 31' it accommodates are inside chamber 631, the tool is squeezed. Lever 66 forces die 64 into chamber 631. Chamber 631 crimps connector 761 around section 31'. Connector 761 is severed from belt 76 by a blade 681 that cuts through web 762. As will be evident from FIGS. 8 and 9, blade 681 extends out of the front of a holder 68. Blade holder 68 is accommodated in another bolt 67 that travels back and forth above the bolt 62 that drives die 64 in cassette 61. The blade holder is forced toward and away from chamber 631 by an articulated lever 69. Lever 69 pivots on the jaw 121 extending out of stationary handle 12. Lever 69 ensures that blade 681 will engage and sever a connector 761 from the web 762 of belt 76 in chamber 631 before die 64 arrives against the connector.

The tool can be perfected with a mechanism for severing a conductor 31. The cassette 61 in this embodiment accommodates still another bolt 81. Bolt 81 travels in opposition to bolts 62 and 67. It has an extension 82 that extends beyond the outer edge of adjustable handle 12. Extension 82 includes an accommodation 821. When a conductor 31 is accommodated in accommodation 821 and the tool is squeezed, the conductor will be severed by a cutter 831. Cutter 831 extends out of the front of a holder 83 that travels back and forth in bolt 81 subject to the two-armed lever 66 that pivots around the same pivot 11 as handles 12 and 13. Holder 83 moves cutter 831 toward and away from accommodation 821. Die 64 and holder 83 are returned to their disengaged position by the same spring 14 on lever 66 that opens the tool when it is released.

Figure 12:
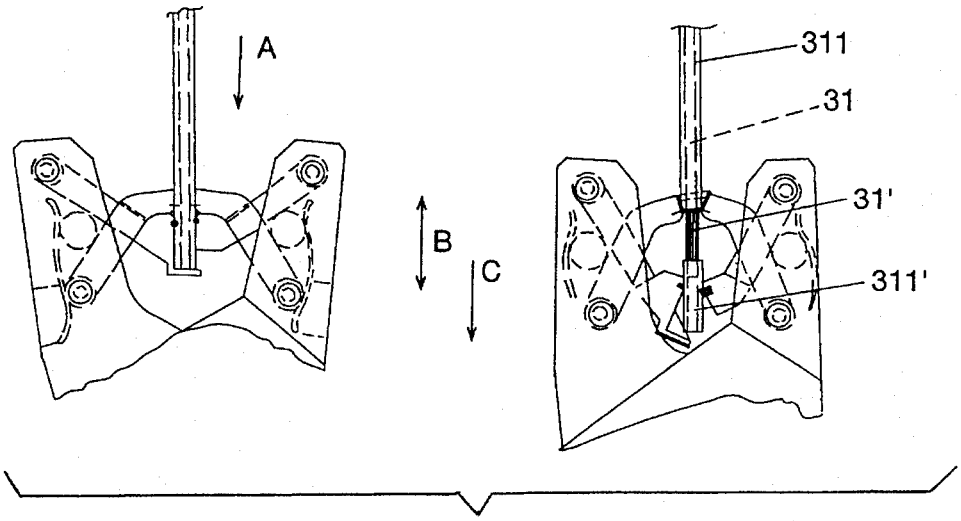

The sequence of operations involved in partly stripping the end of the conductor and twisting the end of the core will be evident from FIGS. 12 through 14 and is accordingly not specified herein.

I claim:

1. A pliers-like tool for twisting a partly stripped end of a multiple-strand core of an insulated conductor, comprising: jaws having free ends and a space between said jaws; projections extending out of each free end of each jaw and toward the other jaw into said space between said jaws;

said projections following an arc described by opening and closing said jaws;

said projections being non-coplanar for leaving a space between said projections;

one of said projections being long enough to overlap the other of said projections to a limited extent when said jaws are separated;

and surfaces on said projections demarcating said space between said projections and being high-friction surfaces.

2. A tool as defined in claim 1, including an adjustable handle associated with one of said jaws and a stationary handle associated with the other of said jaws, overlap of the projection from the jaw associated with said adjustable handle being over the projection from the jaw associated with said stationary handle and having a salient from the other projection defining said space between said projections.

3. A tool as defined in claim 2, including an additional projection paralleling and separated from the projection associated with said stationary handle and limiting motion of said adjustable handle.

4. A tool as defined in claim 2, wherein a space extends at an angle to the projection associated with said adjustable handle and adjacent to an attachment on an end of said projection.

5. A tool as defined in claim 1, wherein said projections include twist projections having a length; and saw-blade sections inlaid in facing surfaces of said twist projections and extending over said length.

6. A tool as defined in claim 5, wherein said twist projections have a limited resilience.

7. A tool as defined in claim 1, wherein said tool is integrated into an insulation-stripping tool with core-twisting means positioned eccentric to said jaws and adjacent a combination of holding-and-cutting jaws associated with pliers for stripping off insulation.

8. A tool as defined in claim 7, wherein an insulation-stripping point is at said cutting jaws adjacent to said holding jaws.

9. A tool as defined in claim 7, wherein one of said combination holding-and-cutting jaws has a backward extension for insertion of a stop limiting how far a conductor is stripped.

10. A tool as defined in claim 7, including an adjustable handle extending through and pivoting in a stationary handle about a pivot; a cassette pivoting inside said adjustable handle around said pivot and accommodating a bolt extending beyond said adjustable handle; an extension on said bolt accommodating a matrix for applying a cylindrical connector to a stripped end of a conductor; and a connector-crimping die forced into said matrix when the handles are squeezed together.

11. A tool as defined in claim 10, including a lever pivoting around said pivot and operating in conjunction with said die.

12. A tool as defined in claim 10, including a clip accommodating a belt of connectors removable from said adjustable handle, said clip opening through an opening into said matrix, said matrix having an extension accommodating said belt; a blade on a free end of a blade holder extending through said adjustable handle and coupled to said stationary handle by a two-armed lever extending into and severing the connector from the rest of the belt.

13. A tool as defined in claim 12, including a screw that screws into said extension of said matrix for adjusting a capacity of said extension and thereby said matrix to connectors of different size.

14. A tool as defined in claim 10, wherein said cassette extending through said adjustable handle is oriented along with another bolt oriented toward an opposite side and extending beyond said adjustable handle with an extension of said other bolt including an accommodation for cutting the conductor so that a blade mounted on a blade holder traveling back and forth inside the bolt is forced into the conductor when the handles are squeezed.

15. A tool as defined in claim 14, including a lever pivoting around said pivot of said handles and operating in conjunction with said die on one hand and with said knife holder on the other hand.

* * * * *